US006679353B1

(12) United States Patent
Muranaka

(10) Patent No.: US 6,679,353 B1
(45) Date of Patent: Jan. 20, 2004

(54) STAIR-CLIMBING CHAIR SYSTEM

(75) Inventor: Masaru Muranaka, Osaka (JP)

(73) Assignee: Kumalift Co. Ltd., Osaka (JP)

( * ) Notice: Subject to any disclaimer, the term of this patent is extended or adjusted under 35 U.S.C. 154(b) by 0 days.

(21) Appl. No.: 09/480,110

(22) Filed: Jan. 10, 2000

(51) Int. Cl.[7] ..... B66B 9/08
(52) U.S. Cl. ..... 187/202; 187/201; 187/246
(58) Field of Search ..... 187/200, 201, 187/202, 245, 392, 246

(56) References Cited

U.S. PATENT DOCUMENTS

| | | | | | |
|---|---|---|---|---|---|
| 420,703 | A | * | 2/1890 | Smith | 187/246 |
| 432,213 | A | * | 7/1890 | Peach | 187/246 |
| 2,581,887 | A | * | 1/1952 | Saxton et al. | 187/202 |
| 2,856,027 | A | * | 10/1958 | Schryver | 187/201 |
| 2,886,136 | A | * | 5/1959 | Stelzer | 187/203 |
| 2,888,099 | A | * | 5/1959 | Hoffman | 187/202 |
| 2,923,379 | A | * | 2/1960 | Stelzer | 187/203 |
| 3,749,202 | A | * | 7/1973 | Puls | 187/202 |
| 4,043,427 | A | * | 8/1977 | Ackerman | 187/202 |
| 4,227,132 | A | * | 10/1980 | Cavil et al. | 318/549 |
| 4,438,830 | A | * | 3/1984 | Born | 187/202 |
| 5,052,521 | A | * | 10/1991 | Wendt et al. | 187/202 |
| 5,152,602 | A | * | 10/1992 | Boschetto | 362/276 |
| 5,241,141 | A | * | 8/1993 | Cominelli | 187/553 |
| 5,476,155 | A | * | 12/1995 | Nakatani et al. | 187/202 |
| 5,533,594 | A | * | 7/1996 | Tremblay et al. | 187/201 |
| 5,590,953 | A | * | 1/1997 | Haslam et al. | 362/276 |
| 5,949,067 | A | * | 9/1999 | Sano | 250/231.13 |
| 6,056,074 | A | * | 5/2000 | Heal et al. | 180/6.48 |
| 6,079,157 | A | * | 6/2000 | Hincher, Sr. | 49/57 |

FOREIGN PATENT DOCUMENTS

| | | | | |
|---|---|---|---|---|
| GB | 2184707 | * | 7/1987 | 187/201 |
| JP | 406064868 | * | 3/1994 | 187/201 |
| WO | 98/31627 | * | 7/1998 | |

* cited by examiner

*Primary Examiner*—Steven B McAllister
(74) *Attorney, Agent, or Firm*—Wenderoth, Lind & Ponack, L.L.P.

(57) ABSTRACT

A stair-climbing system includes a guide rail laid along stairs, a chair slidably mounted on the rail, and a lifter for moving the chair along the rail. The chair is provided with a switch for activating the lifter, and a sensor for detecting that a person is sitting on the chair and keeping the switch inoperative while a person is not sitting on the chair. The system further includes at least one lamp having a sensor adapted to turn on the lamp only while a person is near the lamp. The system further includes a chair stop mechanism having a speed sensor for detecting the speed of the chair, a brake mounted on the lifter for braking the lifter, and a control unit for deactivating the lifter and activating the brake if the speed of the chair, detected by the sensor, exceeds a predetermined value.

5 Claims, 6 Drawing Sheets

STAIR-CLIMBING CHAIR SYSTEM

BACKGROUND OF THE INVENTION

The invention relates to a stair-climbing chair system having improved safety.

FIG. 7 shows a conventional stair-climbing chair system which comprises a guide rail 3 provided along stairs 2, and a chair 4 which can be moved along the guide rail 3 by depressing a switch 5 on the chair 4.

For the safety of users, this system employs what is known as a dead-man arrangement in which the chair is activated only while the switch 5 is depressed by the user. Thus, a user has to keep pressing the switch 5 until he or she reaches his or her destination. In an emergency, the user can instantly stop the chair simply by releasing the finger from the switch 5.

This system is further provided with emergency stop switches 6 on the chair and at the boarding areas. When either of the switches 6 is pressed, a brake mounted on the chair 4 stops the chair instantly.

But this safety measure is not perfect for the following reasons.

(1) No provision is made for preventing the chair from moving suddenly if a user presses the switch unintentionally when sitting on or standing up from the (2) No nighttime lighting is provided for illuminating the walkway of users. For particularly elderly users, this can cause an accident. The light may be kept on for this purpose. But keeping the light always turned on is a waste of energy.

(3) If an overweight user is on the chair, it may descend at an excessive speed due to gravity, shaking off the restriction by an emergency stop mechanism, and collide against the floor.

SUMMARY OF THE INVENTION

According to the present invention, there is provided a stair-climbing chair system comprising a guide rail laid along stairs, a chair slidably mounted on the rail, and a lifter for moving the chair along the rail. The chair is provided with a switch for activating the lifter, and a sensor is provided on the chair for detecting that a person is sitting on the chair and keeping the switch operative only while a person is sitting on the chair.

With this arrangement, the switch will not be turned on unless the user sits on the chair.

According to this invention, a lamp is provided which has a sensor adapted to turn the lamp on only while a person is near the lamp, and provided at a boarding station or at a predetermined location along the rail.

With this arrangement, the lamp will be automatically turned on to illuminate the walkway of the user, Thus the user can get on and off the chair safely.

With this arrangement, if the user is overweight so that the chair descends at an overspeed, the controller will stop the motor and activate the brake. If the free-fall preventive means should fail, the speed sensor will detect the overspeed and activate the brake. This ensures safety of the user.

DETAILED DESCRIPTION OF THE PREFERRED EMBODIMENT

Figure 1:
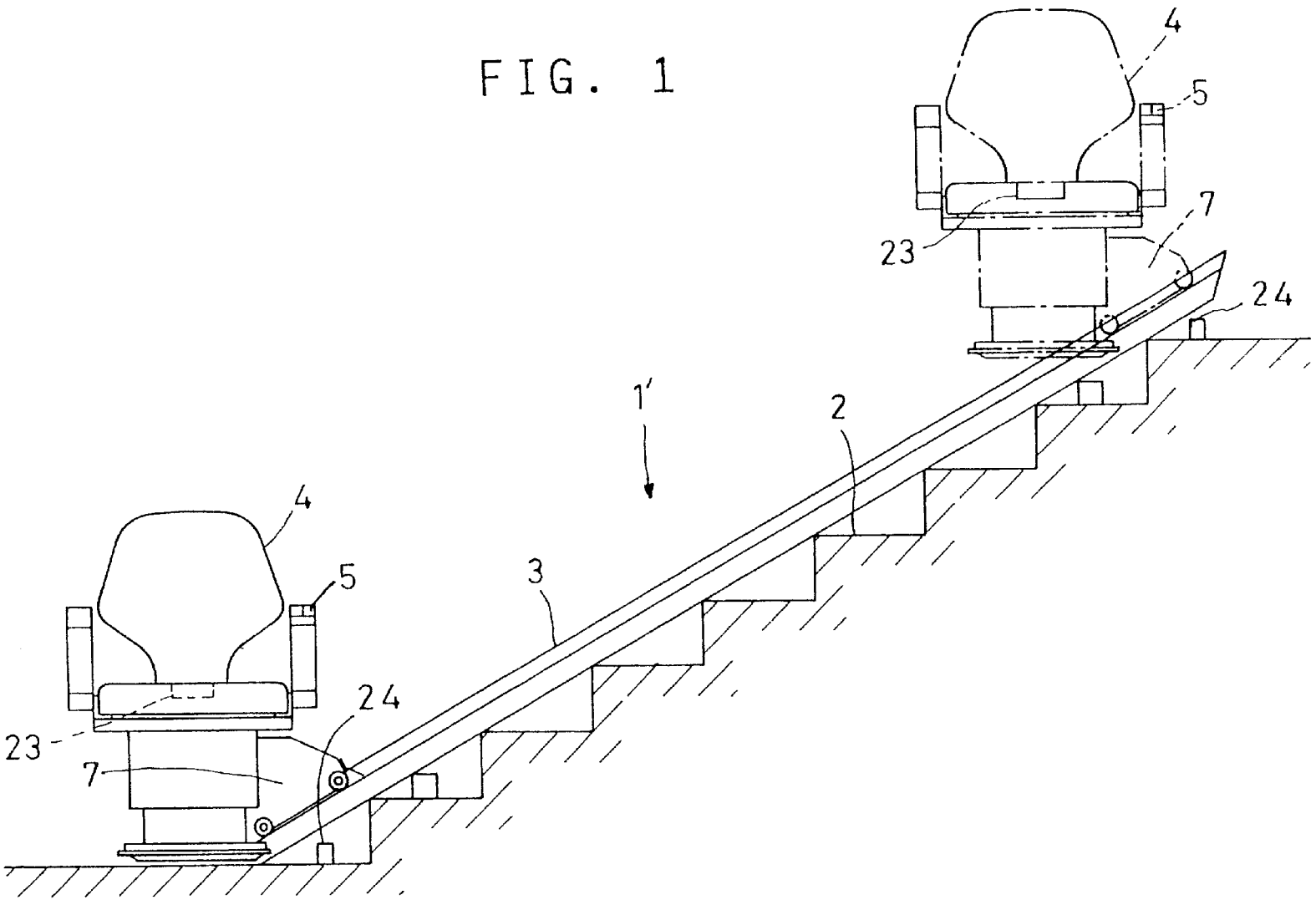
FIG. 1 is a front view of a system embodying the present invention.

Referring first to FIG. 1, the stair-climbing chair system embodying the present invention comprises a guide rail 3 laid along stairs 2, and a chair 4 provided so as to move along the guide rail 3 by a lifter 7.

Figure 2:
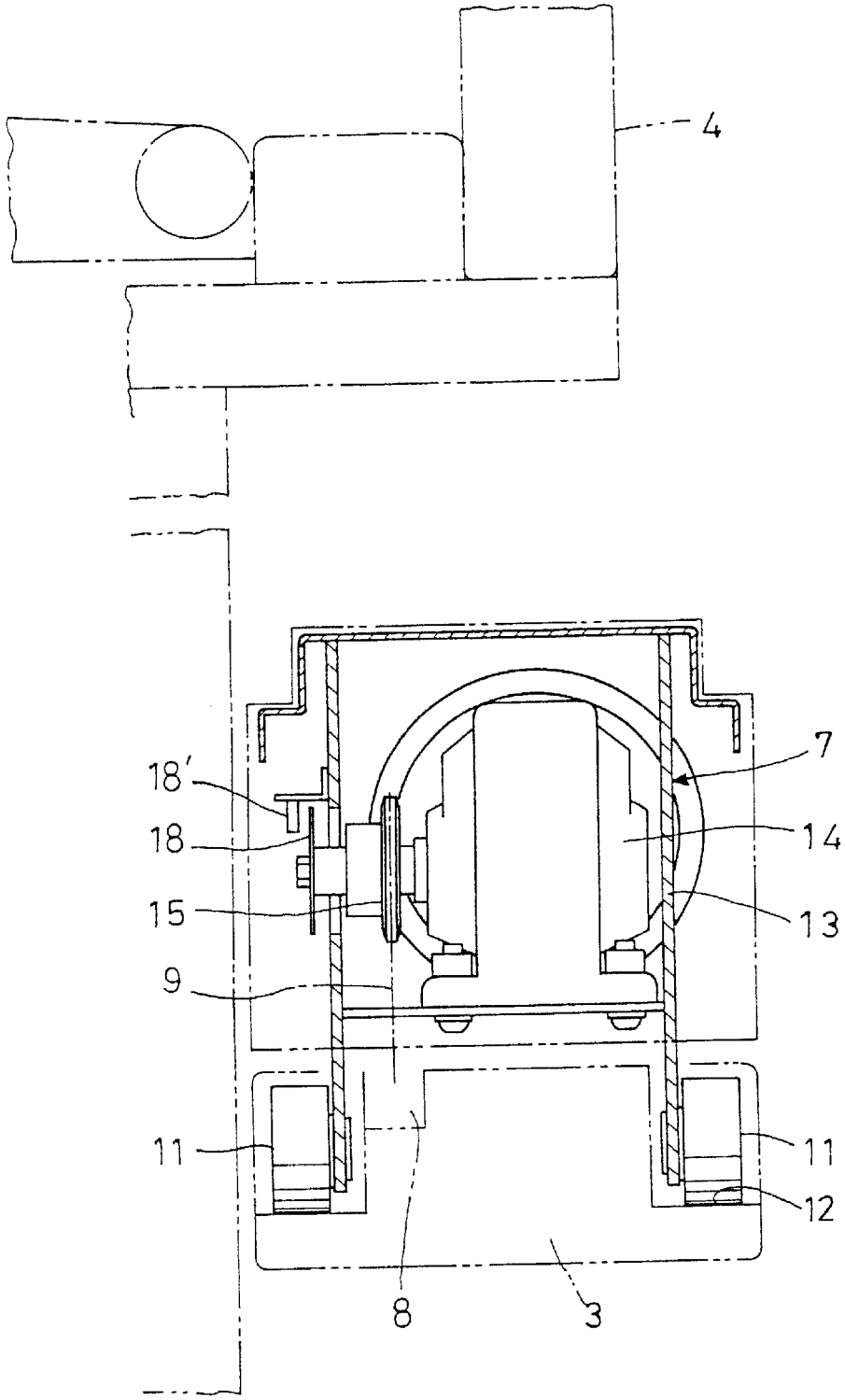
FIGS. 2 to 4 are partial enlarged views of the system shown in FIG. 1.

As shown in FIG. 2, the guide rail 3 is formed with a groove 8 in which is received a chain 9 of the lifter 7. The chain 9 has both ends (not shown) fixed. Flat surfaces 12 are formed on both sides of the rail 3. Two rollers 11 are provided on each side of the lifter 7, and the rollers are supported on the flat surfaces 12 of the rail 3.

Still referring to FIG. 2, the lifer 7 includes a motor 14 mounted on a frame 13 and carrying a sprocket 15 in mesh with the chain 9.

Figure 3:
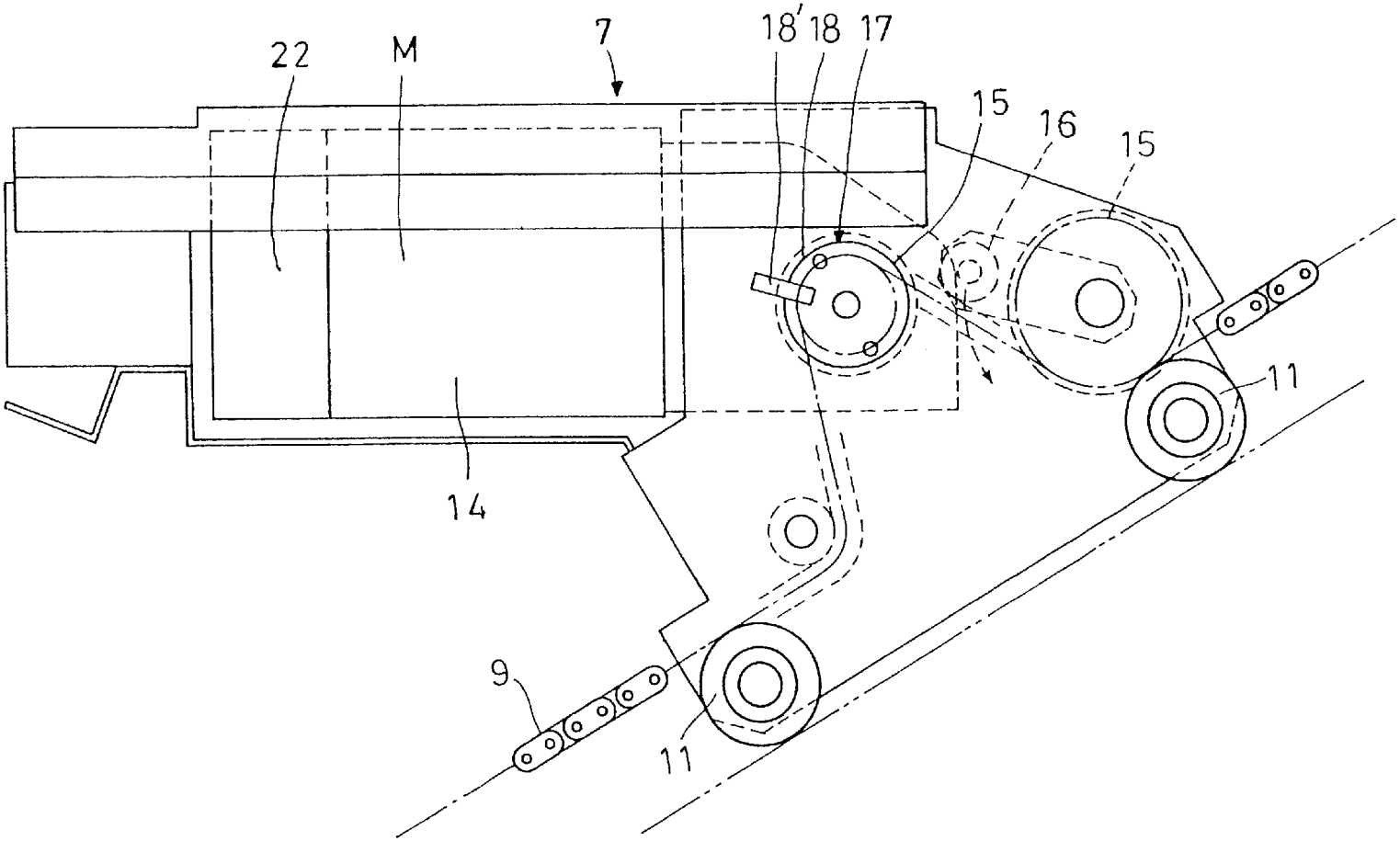

By driving the sprocket 15 with the motor 14, as shown in FIG. 3, the chair can move up and down the stairs 2 along the rail 3.

The lifter 7 has a free-fall preventive mechanism 16 and an overspeed detector 17.

Referring to FIG. 3, the free-fall preventive mechanism 16 is what is called a "slack chair safety device" and comprises an arm having one end thereof pivotally coupled to e.g. the shaft of an idler sprocket 15, and a roller provided at the other end of the arm and kept in contact with the chain 9. If the chain 9 is cut, the arm will pivot counterclockwise by gravity, as shown by the arrow in FIG. 3, until the other end of the arm engages the guide rail 3 to stop the lifter 7 and the chair 4.

The overspeed detector 17, as shown in FIG. 3, comprises an encoder disk 18 mounted on the output shaft of the motor 14 (see FIG. 2), a light sensor 18' for producing a signal representative of the rotating speed of the disk 18, and a control circuit 19 (FIG. 5) for detecting the rotating speed of the disk 18 based on the signal from the sensor 18'.

The disk 18 is formed with e.g. two diametrically opposite slits. Thus, the circuit 19 detects two pulses per rotation of the disk. The circuit 19 is programmed to deactivate the motor 14 and activate a solenoid brake 22 for the lifter 7 if the number of pulses counted per unit time is over twice the normal count.

The chair 4 is fixed to the frame 13 of the lifter 7. As shown in FIG. 1, a lifter activating switch 5 is provided on one of the armrests of the chair. The switch 5 comprises self-return type press buttons having large top surfaces so that even elderly users can easily and reliably press the right button, and the switch 5 is connected to the control circuit 19 as shown in FIG. 5.

Figure 4:
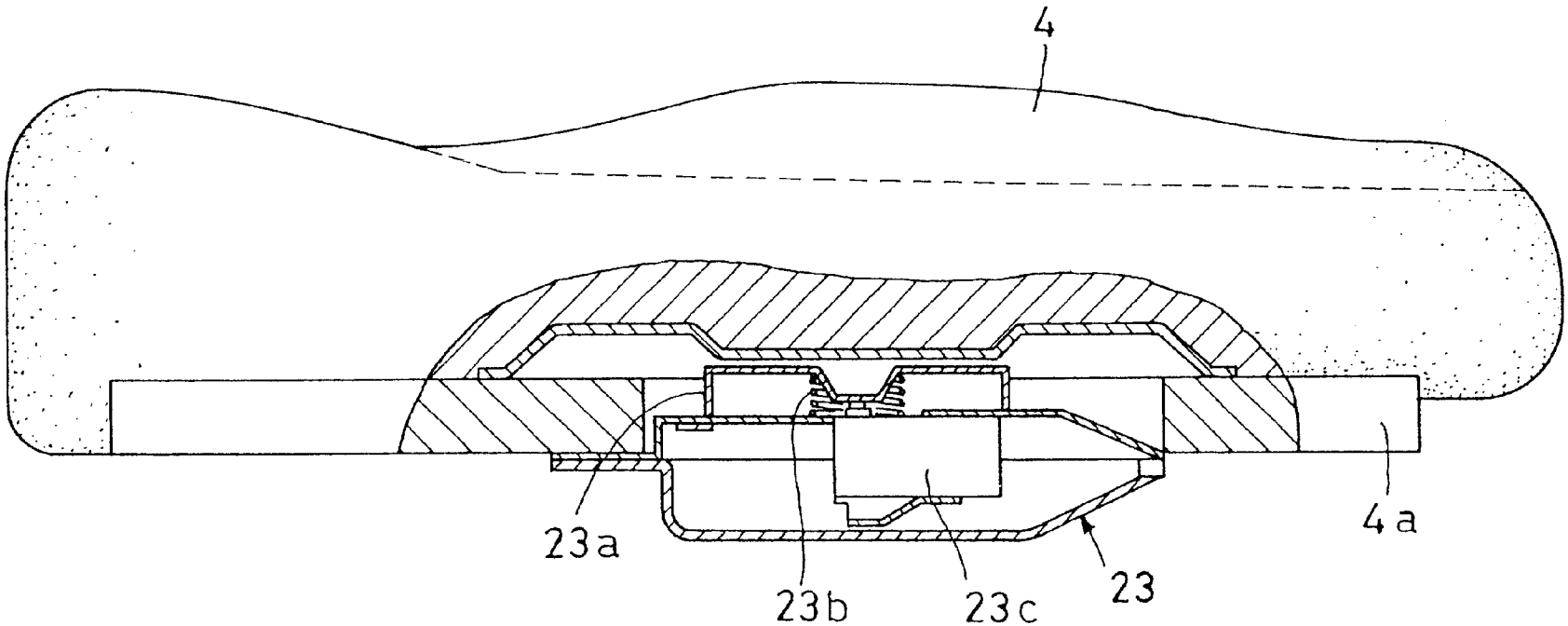

The chair 4 is further provided with a sensor 23 for detecting the fact that a user is seated on the chair. As shown in FIG. 4, the sensor is mounted in a hole formed in the center of the seat 4*a* of the chair 4, and comprises a pressure-receiving plate 23*a*, and a microswitch 23*c* supporting the plate 23*a* through a spring 23*b*. When a pressure higher than a predetermined level is applied to the microswitch 23*c* from the plate 23*a* through the spring 23*b*, the sensor 23 is actuated. The sensor 23 otherwise remains off. When someone sits on the chair, the sensor 23 turns on and when he or she stands up from the chair, it turns off.

Figure 5:
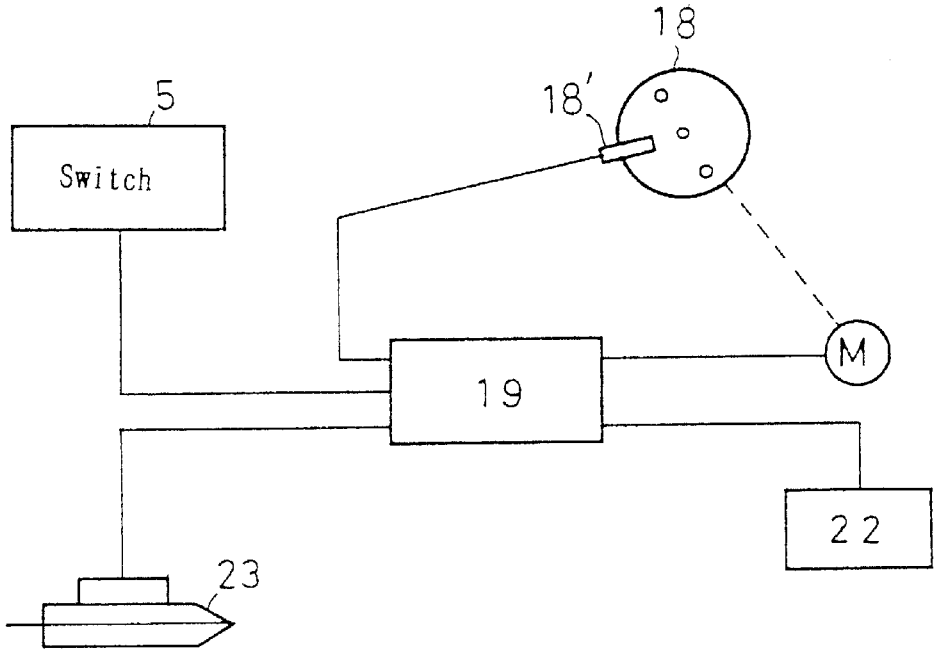
FIG. 5 is a block diagram of the system shown in FIG. 1.

The sensor 23 is also connected to the control circuit 19 as shown in FIG. 5, and the circuit 19 is programmed to keep the switch 5 operative only while the switch 23 is on. Thus, it is impossible to move the chair unless someone is sitting on the chair.

The sensor 23 in this embodiment is a pressure sensor. But a different sensor such as one using light or a dielectric plate may be used. Also, a pressure sensor not using a microswitch may be used.

At the boarding stations, sensor-activated lamps 24 are provided (FIG. 1). Typical sensors used with the lamps 24 are infrared sensors adapted to detect heat and turn on the lamps 24. Thus, the lamps 24 are turned on only while the chair with a person thereon is near the lamps and otherwise remain off. Such sensor-activated lamps 24 may also be provided along the rail 3 at suitable intervals so that the user can find any obstacles along the rail and stop the chair instantly.

The lamps 24 are provided to illuminate the walkway of the user as shown in FIG. 1. When a person approaches a boarding area, the lamp 24 is automatically turned on to illuminate the footsteps of the user so that he or she can get on the chair safely.

The seating sensor 23 keeps the switch 5 inoperative until the user sits on the chair so that the chair does not move inadvertently while the user is not seated on the chair.

If the overspeed detector 17 detects that the chair is descending at a higher speed than a predetermined speed due to the heavy weight of the user, the control circuit 19 will turn off the motor 14 and activate the brake 22 to stop the chair 4.

If the chain should break, the free-fall preventive unit 16 will be activated to stop the chair instantly. Even if the unit 16 should not work, the overspeed detector 17 will detect the overspeed of the chair and activate the brake 22 to stop the chair instantly.

When a person approaches a boarding area, the lamp 24 is automatically turned on to illuminate his footsteps so that he can get off the chair safely.

Thus the sensor 23, the detector 17 and the lamps 24 will prevent accidents. This system can thus be used safely.

Figure 6:
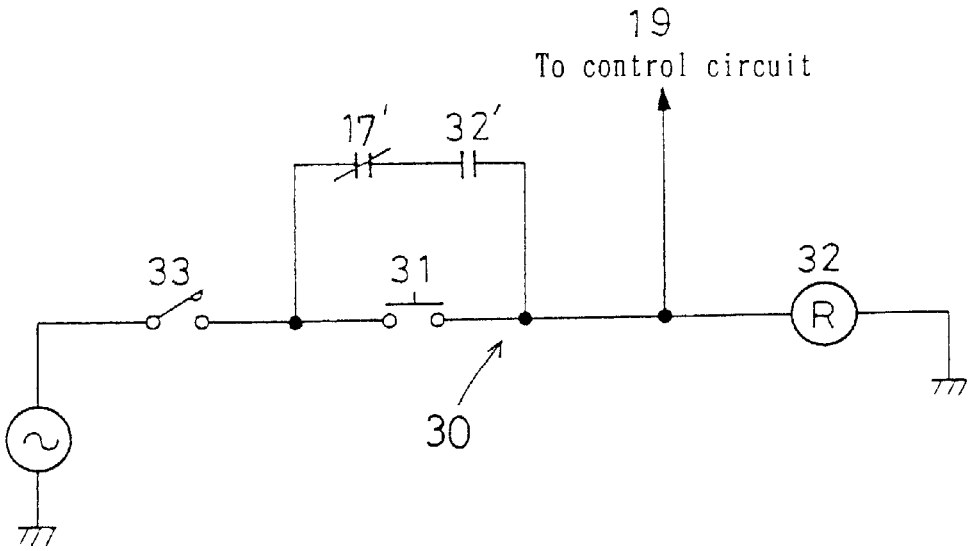
FIG. 6 is a circuit diagram of another embodiment of the present invention.
Figure 7:
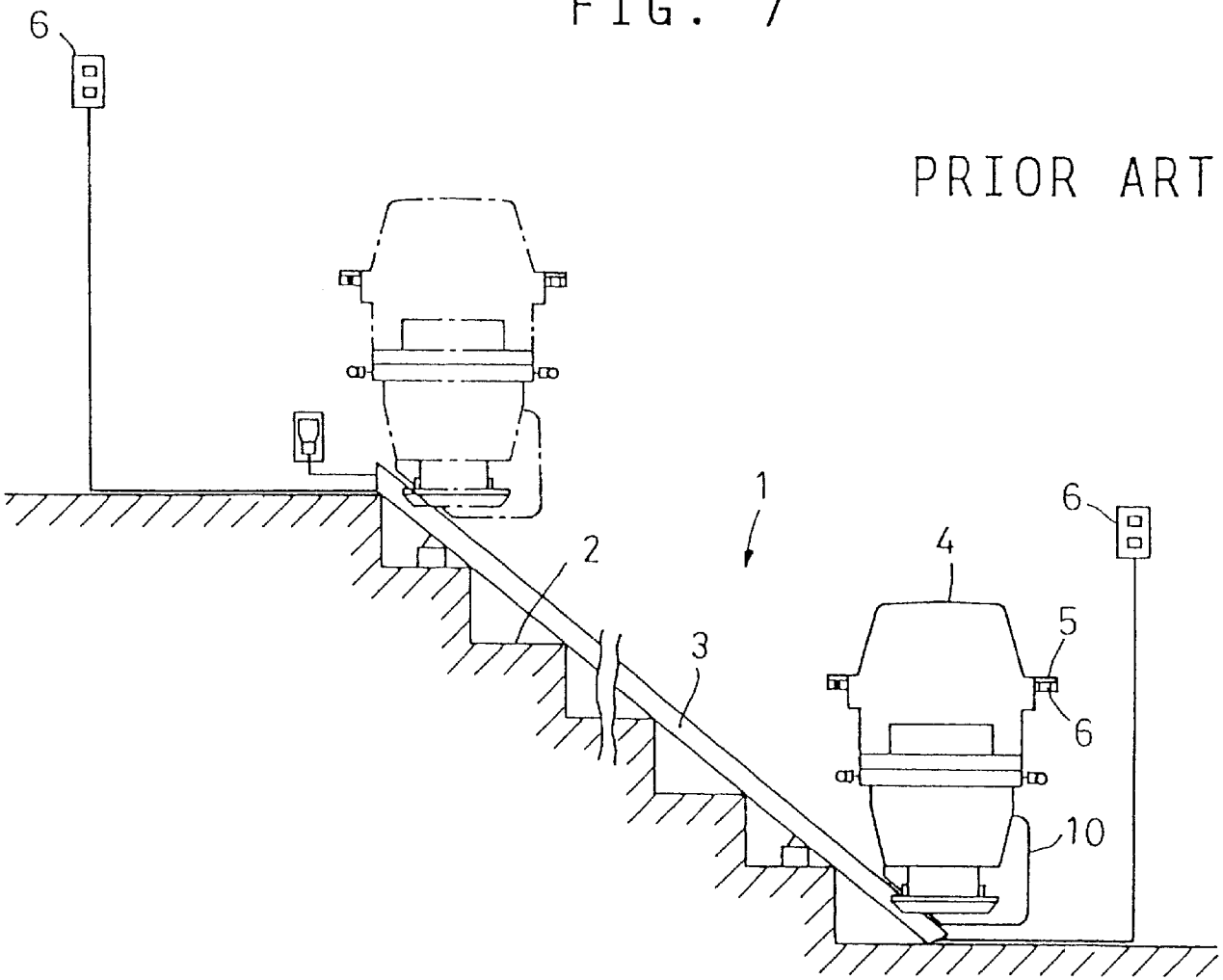
FIG. 7 PRIOR ART
FIG. 7 is a view showing a conventional system.

To this system, a self-retaining circuit 30 shown in FIG. 6 may be added. This circuit includes a reset switch 31 and a retainer relay 32. The retainer relay 32 has a retaining contact 32' connected in series with an off contact 17' of the overspeed detector 17. The reset switch 31 is provided in parallel with the contacts 17' and 32'. The contact 17' is normally closed but will open only while the overspeed detector 17 is activated.

The self-retaining circuit 30 itself is connected in series between the main switch 33 of the system and the control circuit 19 as shown. In this arrangement, if the overspeed detector 17 is activated, the off contact 17' opens. When the contact 17' opens, the relay 32 is turned off. This causes the contact 32' to open. Thus, even though the contact 17' recloses as soon as the overspeed detector 17 is deactivated, the contact 32'0 open, so that even if the main switch 33 is closed, the system remains deactivated. To reactivate the system in this state, the reset switch 31 has to be closed. When the reset switch 31 is closed with the main switch 33 also closed, the retainer relay 32 is activated, so that the contact 32' recloses. Thus, even after the reset switch 31 opens, current flows through the main switch 33, contacts 17' and 32' to the control circuit, and the system is activated. Thus, in order to restart the system after the overspeed detector 17 has been activated, it is necessary to close the reset switch 31 together with the main switch 33. This prevents the system from being reactivated inadvertently by closing the main switch 33 alone by mistake.

What is claimed is:

1. A stair-climbing system comprising:

a guide rail laid along a flight of stairs;

a chain stretched along said guide rail;

a lifter including a motor having a rotary shaft to which is secured a sprocket in engagement with said chain such that said lifter is movable along said guide rail by driving said motor;

a chair supported on said lifter;

a switch for activating said motor;

a sensor provided on said chair for detecting a predetermined load applied to said chair and keeping said switch operative while a load is being applied to said chair; and a free-fall preventive mechanism comprising an arm having one end thereof pivotably coupled to said lifter, and a roller rotatably mounted on another end of said arm so as to be in contact with said chain, said arm being adapted to pivot downwardly by gravity until said another end of said arm contacts said guide rail if said chain is cut.

2. A stair-climbing system as claimed in claim 1, further comprising a lamp having a sensor adapted to turn said lamp on when a person is near said lamp, wherein said lamp is provided at a boarding station or at a predetermined location along the rail.

3. A stair-climbing system as claimed in claim 1, further comprising a chair stop mechanism comprising a speed detector for detecting the speed of said chair, a brake mounted on said lifter for braking said lifter, and a control unit for deactivating said lifter and activating said brake if the speed of said chair, detected by said sensor, exceeds a predetermined value.

4. A stair-climbing system as claimed in claim 3, wherein said speed detector includes an encoder disk having diametrically opposed slits, and a light sensor, said light sensor being capable of producing a signal representative of a rotating speed of said encoder disk.

5. A stair-climbing system as claimed in claim 1, wherein said sensor comprises a microswitch mounted on a seat of said chair and a pressure-receiving plate supported on said microswitch via a resilient member.

* * * * *